US009897399B2

(12) United States Patent
Kröger et al.

(10) Patent No.: US 9,897,399 B2
(45) Date of Patent: Feb. 20, 2018

(54) WATER COLLECTION TROUGH ASSEMBLY

(71) Applicants: Stellenbosch University, Stellenbosch, Western Cape Province (ZA); Klaus von Pressentin

(72) Inventors: Detlev Gustav Kröger, Stellenbosch (ZA); Hanno Carl Rudolf Reuter, Stellenbosch (ZA)

(73) Assignee: Stellenbosch University, Stellenbosch, Western Cape Province (ZA)

( * ) Notice: Subject to any disclaimer, the term of this patent is extended or adjusted under 35 U.S.C. 154(b) by 0 days.

(21) Appl. No.: 15/036,018

(22) PCT Filed: Nov. 11, 2014

(86) PCT No.: PCT/IB2014/065949
§ 371 (c)(1),
(2) Date: May 11, 2016

(87) PCT Pub. No.: WO2015/071822
PCT Pub. Date: May 21, 2015

(65) Prior Publication Data

US 2016/0290745 A1 Oct. 6, 2016

(30) Foreign Application Priority Data

Nov. 12, 2013 (ZA) ..... 2013/08443

(51) Int. Cl.
*B01F 3/04* (2006.01)
*F28F 25/04* (2006.01)

(52) U.S. Cl.
CPC ..... *F28F 25/04* (2013.01); *B01F 3/04* (2013.01); *B01F 3/04078* (2013.01); *B01F 3/04468* (2013.01)

(58) Field of Classification Search
CPC .... B01F 3/04; B01F 3/04078; B01F 3/04468; F28F 25/02; F28F 25/04
(Continued)

(56) References Cited

U.S. PATENT DOCUMENTS 1,647,281 A * 11/1927 Doyle ..... F28C 1/02 261/111
4,385,010 A * 5/1983 Bosne ..... F28F 25/04 261/110

(Continued)

FOREIGN PATENT DOCUMENTS

DE 2250776 A1 4/1974
GB 734185 A 7/1955

*Primary Examiner* — Robert A Hopkins
(74) *Attorney, Agent, or Firm* — Knobbe, Martens, Olson & Bear, LLP

(57) ABSTRACT

A liquid collection trough assembly for a cooling tower, condenser or dephlegmator includes a plurality of elongate troughs and associated inclined capture plates arranged to receive liquid on a front face thereof and direct the liquid into an associated elongate trough. Each capture plate has a generally upright deflection plate extending downwards from an upper region on its rear face so as to be capable of receiving liquid droplets contacting it and directing such liquid into or onto an adjacent trough or capture plate, in use. The deflection plate extends downwards to terminate in a bottom edge that is located downwards of the upper region of the capture plate and spaced rearwards of the rear face of an inclined portion of the capture plate.

8 Claims, 3 Drawing Sheets

(58) Field of Classification Search
USPC ..... 261/110, 111, DIG. 11, DIG. 85
See application file for complete search history.

(56) References Cited

U.S. PATENT DOCUMENTS

| | | | | |
|---|---|---|---|---|
| 4,521,350 | A * | 6/1985 | Lefevre | F28F 25/04 261/111 |
| 9,273,915 | B2 * | 3/2016 | Patel | |
| 2012/0111762 | A1 | 5/2012 | Patel | |

* cited by examiner

WATER COLLECTION TROUGH ASSEMBLY

FIELD OF THE INVENTION

This invention relates to a water collection trough assembly for use in air-cooled heat exchangers such as cooling towers having fill over which water to be cooled flows and heat exchangers having deluged tube bundles such as those in condensers, dephlegmators and the like over which water flows to transfer heat to or from the tubes.

BACKGROUND TO THE INVENTION

Water collection trough assemblies are used in the heat exchanger industry in counter flow cooling towers to collect and remove water falling from the bottom of a cooling tower fill or from a heat exchanger tube bundle.

Forced draught cooling towers require water collection trough assemblies in order to collect water falling from the fill of the cooling tower or other water cooling facility to enable the water to be recycled or disposed of in an effective way.

Collecting troughs are used in forced draught cooling towers; in cooling towers where the rain zone is eliminated to reduce pumping power; in counter-flow cooling tower fill test facilities; and in deluged evaporative heat exchangers, to collect and remove water dripping from the base of the cooling tower fills or heat exchanger tube bundles while allowing it to pass vertically through them.

Effective recovery of the water also reduces damage to, and maintenance of, fans and drives which create air flow through a heat exchange facility.

Inefficient recovery of water can also result in increased power consumption and water spillage, which has a negative environmental impact due to the contaminants in the water.

Numerous different water collection assemblies have been developed some of which have fairly complicated geometries. Some of them unduly increase the pressure drop of air flowing upwards and thereby increase power consumed by one or more fans inducing the flow of air.

Some water collection assemblies have multiple parallel troughs extending in one direction beneath the fill of a cooling tower or tube bundle with an upwardly inclined capture plate having its lower edge arranged to feed water falling onto the capture plate into an associated trough. The troughs and capture plates are arranged to extend over substantially the entire area beneath the fill or tube bundle, as the case may be, so that all water that drips from the fill or tube bundle falls onto a capture plate or directly into a trough. U.S. Pat. No. 4,521,350 describes such an arrangement.

The difficulty with this arrangement is that water drops falling on the capture plate tend to splash and at least a part of the resultant spray can find its way between the troughs thereby failing to be caught by the trough and capture plate assembly. This has led, in at least some instances, to a second layer of collection troughs and capture plates being located beneath a first one.

Measurements done on an existing collection trough assembly comprising two layers of troughs installed in a cooling tower fill test facility have shown that about 10% of the water passes through the first layer of troughs.

In dephlegmators of the type used in steam condensation installations operated in a wet, evaporatively cooled mode, collection trough assemblies may be provided beneath tube bundles in order to collect run-off water and enable recycling of excess deluge water.

There is a need for a water collection trough assembly that alleviates some of the problems mentioned above, at least to some extent.

SUMMARY OF THE INVENTION

In accordance with this invention there is provided a liquid collection trough assembly comprising a plurality of elongate troughs and associated inclined capture plates wherein each capture plate is arranged to receive liquid contacting same on a front face thereof and direct the liquid into an associated elongate trough, the liquid collection trough assembly being characterised in that each capture plate has a generally upright deflection plate extending downwards from an upper region thereof on its rear face so as to be capable of receiving liquid droplets contacting it and directing such liquid into or onto an adjacent trough or capture plate, in use, wherein the deflection plate extends downwards to terminate in a bottom edge that is located downwards of the upper region of the capture plate and spaced rearwards of the rear face of an inclined portion of the capture plate.

Further features of the invention provide for the troughs and associated inclined capture plates to be spaced apart such that the upper edge of each of the capture plates is located over a lower edge region of an adjacent capture plate to define inclined flow paths for air between the capture plates; for a capture plate to be formed as an upward extension of one wall of the trough, in each case; for the deflection plate to be attached along a top edge of an associated capture plate; and for the top edge region of the capture plate and any superimposed deflection plate to be inwardly curved towards the face of the capture plate in a manner tending to redirect air passing in an inclined direction between adjacent capture plates to a more vertically extending direction.

Yet further features of the invention provide for the water collection troughs to be arranged all in the same horizontal plane. Alternatively, the water collection troughs may be at regularly staggered vertical positions in a plurality of vertically spaced horizontal planes. In the latter instance, available area for flow of air is increased between adjacent troughs.

Each elongate trough may be open at either or each end to allow for drainage of liquid collected therein, typically into manifolds or other collection ducts. Alternatively, a trough may have at least one drainage outlet along its length.

The invention also provides, in combination, a water collection trough assembly as defined above installed beneath a fill or tube bundle of a cooling tower or condenser or dephlegmator.

In order that the invention may be more fully understood, different embodiments thereof will now be described with reference to the accompanying drawings.

DETAILED DESCRIPTION WITH REFERENCE TO THE DRAWINGS

Figure 1:
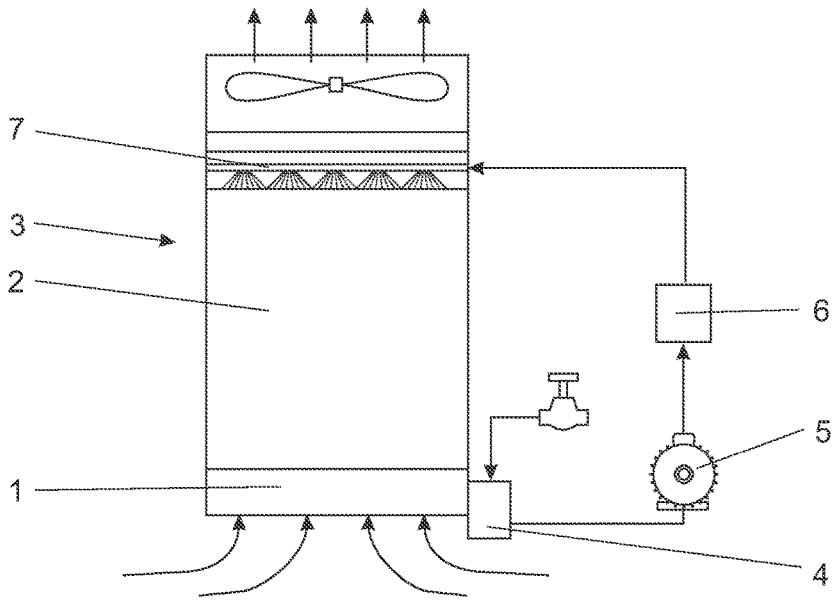
FIG. 1 is a schematic diagram showing the circuit of a cooling tower embodying a water collection trough assembly according to the invention.

In the application of the invention illustrated in FIG. 1, a water collection trough assembly, generally indicated by numeral (1), is arranged beneath the fill (2) of a cooling tower that is generally indicated by numeral (3) and can be made of metal, plastic or metal extrusion. The cooling tower includes a water collection sump (4), a circulating pump (5) for supplying recirculated coolant water to a heat generating process generally indicated by numeral (6); and a hot water distribution installation (7) at the top of the fill (2).

Figure 2:
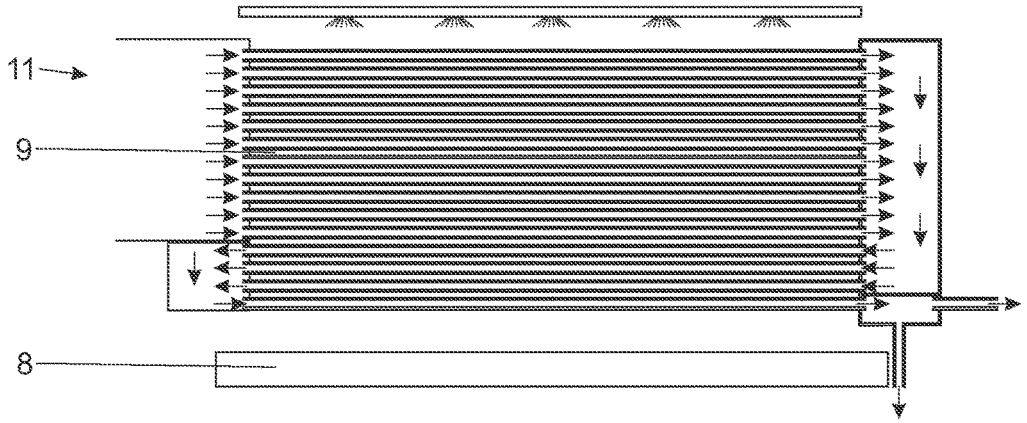
FIG. 2 is a schematic diagram showing a heat exchanger tube bundle having associated therewith a water collection trough assembly according to the invention.

As an alternative, in a different application of the invention that is illustrated in FIG. 2, a water collection facility (8) such as a delugable dephlegmator or an air cooled heat exchanger may be installed beneath a tube bundle (9) of a condensation device such as a dephlegmator, generally indicated by numeral (11).

In either event, the water collection trough assembly comprises a plurality of elongate troughs (12) and associated inclined capture plates (13) wherein each capture plate is arranged to receive liquid contacting same on a front face (14) thereof and to direct the liquid into the associated elongate trough.

Figure 3:
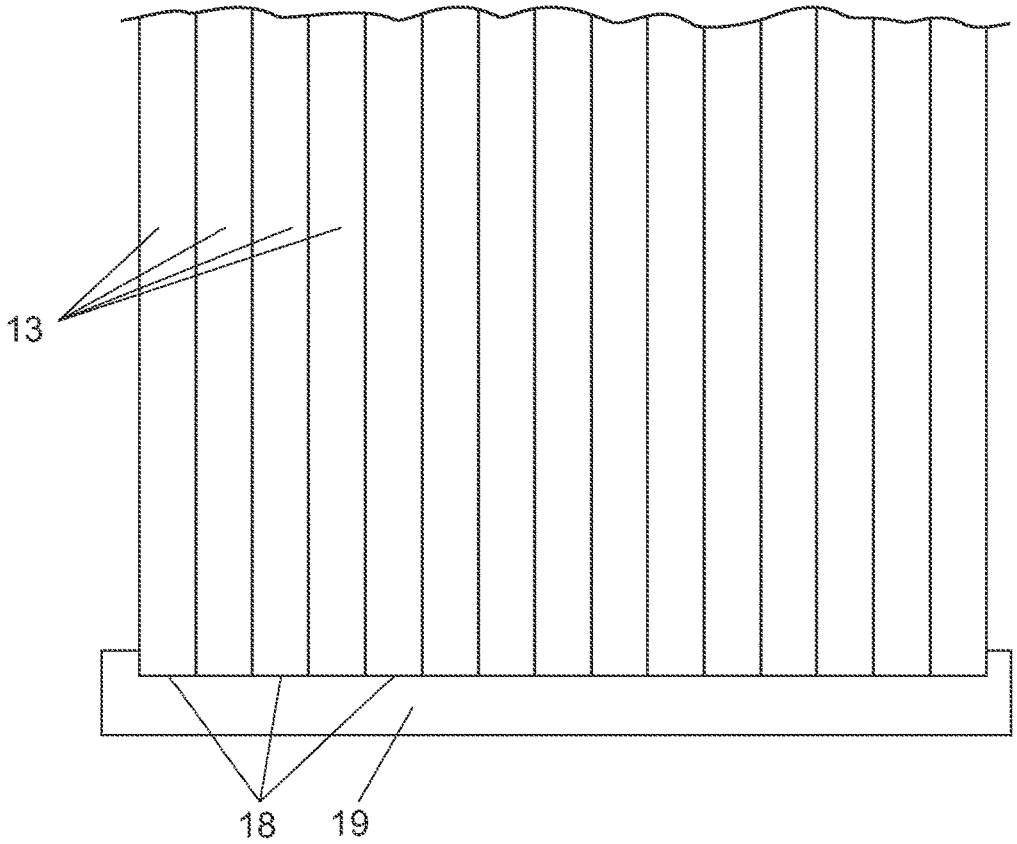
FIG. 3 is a plan view of a part of a water collection trough assembly of the type included in the cooling tower or heat exchanger tube bundle arrangements illustrated in either FIG. 1 or 2.

The capture plate is, in each instance, arranged so that the troughs are spaced apart with the upper edge (15) of each of the capture plates being located over a lower edge region (16) of an adjacent capture plate to define inclined flow paths (17) for air between the capture plates. A capture plate may be formed as an upward extension of one wall of the trough in each case. That aspect of the arrangement is particularly illustrated in FIG. 3. Each elongate trough may be open at either or each end (18) to allow for drainage of liquid collected therein, typically into a manifold or other collection duct (19).

As provided by this invention, a generally upright deflection plate (21) extends downwards from an upper region, in this instance the upper edge (15), of the capture plate on its rear face (22) so as to be capable of receiving liquid droplets contacting it and directing such liquid into the lower region of an adjacent capture plate or even the trough associated with the latter, in use.

In this instance the upper region (23) of the capture plate is generally vertical and the deflection plate is superimposed over that upper region and extends downwards beyond it to terminate in a bottom edge (24) that is located downwards of the said upper region and spaced rearwards of the rear surface of the inclined portion of the capture plate. It will be seen from FIG. 4 that this arrangement causes the gap between the inclined portions of the two adjacent capture plates to be narrowed somewhat and it is important from the point of view of resistance to the upward flow of air that the lower edge of the deflection plate be suitably located. Each design will dictate its own preferred position of the lower edge of the deflection plate.

Figure 4:
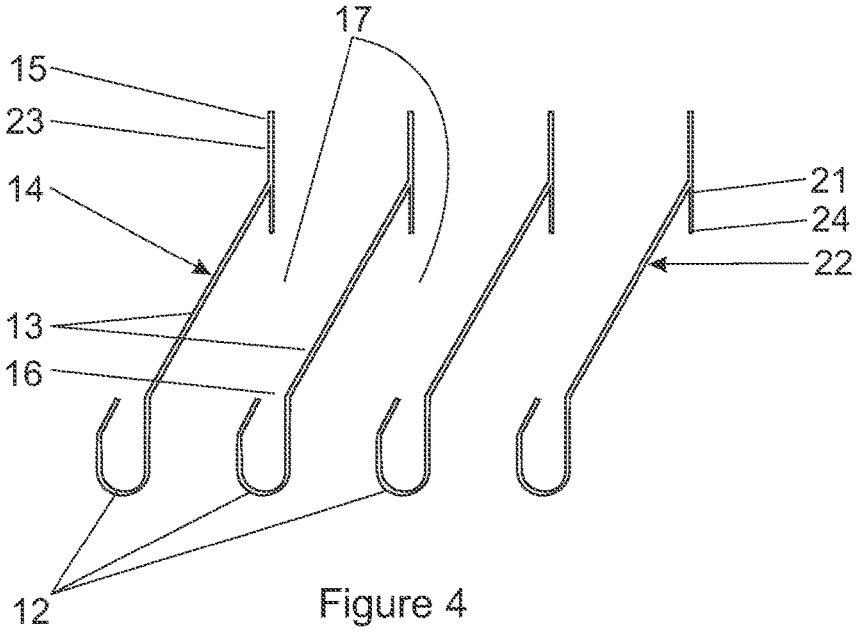
FIG. 4 is an end view of a plurality of water collection troughs according to the invention in which the troughs are arranged in a single horizontal plane.

It will also be seen from FIG. 4 that the lower edge of the deflection plate is located vertically above the lower region of the adjacent inclined capture plate so that drops forming on the deflection plate can run down and fall onto the lower region of the capture plate or even directly into the trough with which the latter is associated.

In the variation of the invention illustrated in FIG. 4, the troughs are all arranged at an equal vertical height so that they are coplanar in a horizontal direction.

Figure 5:
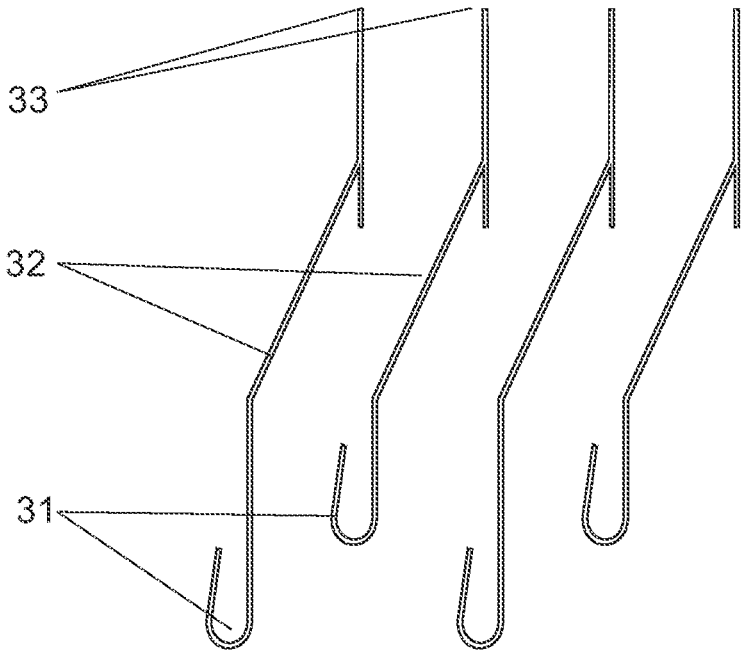
FIG. 5 is an end view of a plurality of water collection troughs that are arranged in staggered vertical positions in two vertically spaced horizontal planes; and, FIG. 6 is an end view of a plurality of water collection troughs wherein the upper edge regions of the capture plates and deflection plates have inwardly curved upper edges.

Alternatively, as illustrated in FIG. 5, the water collection troughs (31) may be located alternately at staggered vertical positions in vertically spaced horizontal planes with the capture plates (32) all being parallel and being of different lengths in the direction in which they extend so that the upper ends (33) are all coplanar in a single horizontal plane. In this instance the available area for flow of air is increased between adjacent troughs.

Figure 6:
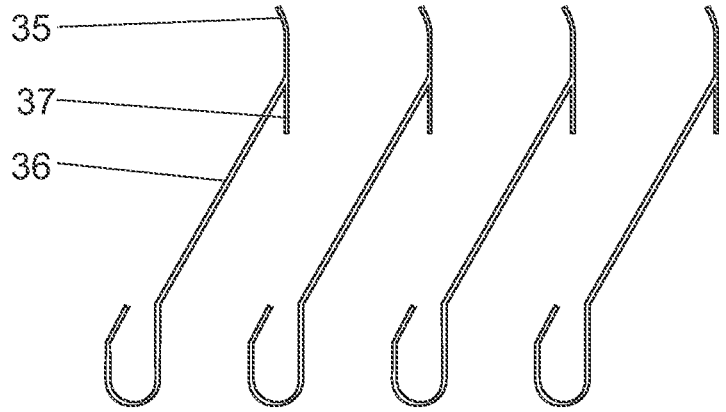

As illustrated in FIG. 6, the top edge region (35) of the capture plates (36) and any superimposed deflection plates (37) may be inwardly curved towards the front and upwardly directed face of the capture plate in a manner calculated to impart a change of direction to air passing between the capture plates. This change of direction is aimed at redirecting air passing in an inclined direction between adjacent capture plates to flow in a more vertically extending direction.

In use, water drops falling due under the influence of gravity from the fill of a cooling tower or from a tube bundle of a deluge system impinge on the capture plates and are directed into the associated trough. As there is usually air flow in the opposite direction, to cool the falling liquid, some water may become directed towards the back of the capture plate and impinge on the deflection plate.

Due to the presence of the deflection plates at the back of the water collection device water impinging on the deflection plates is intercepted and prevented from contacting the back of the inclined capture plate (22). Instead, it runs down the back of the vertical deflection plate and falls into the adjacent trough. The water drops are thus either directed into the trough of another collection trough situated directly behind it, or onto a lower region of its capture plate. This water is thus collected in one or other trough.

Numerous variations may be made to what is described above without departing from the scope of the invention.

The invention claimed is:

1. A liquid collection trough assembly comprising a plurality of elongate troughs and associated inclined capture plates wherein each capture plate is arranged to receive liquid contacting same on a front face thereof and direct the liquid into an associated elongate trough, the liquid collection trough assembly wherein each capture plate has a generally upright deflection plate extending downwards from an upper region thereof on its rear face so as to be capable of receiving liquid droplets contacting it and directing such liquid into or onto an adjacent trough or capture plate, in use, wherein the deflection plate extends downwards to terminate in a bottom edge that is located downwards of said upper region of the capture plate and spaced rearwards of the rear face of an inclined portion of the capture plate and wherein a top edge region of each capture plate and any superimposed deflection plate are vertically extended or inwardly curved towards the face of the capture plate in a manner tending to redirect air passing in an inclined direction between adjacent capture plates to a more vertically extending direction.

2. A liquid collection trough assembly as claimed in claim 1 in which the troughs and associated inclined capture plates are spaced apart such that an upper edge of each of the capture plates is located over a lower edge region of an adjacent capture plate to define inclined flow paths for air between the capture plates.

3. A liquid collection trough assembly as claimed in claim 1 in which each capture plate is formed as an upward extension of one wall of the trough.

4. A liquid collection trough assembly as claimed in claim 1 in which a deflection plate is attached along an upper edge of an associated capture plate.

5. A liquid collection trough assembly as claimed in claim 1 in which the water collection troughs are arranged all in the same horizontal plane.

6. A liquid collection trough assembly as claimed in claim 1 in which each elongate trough is open at either or each end to allow for drainage of liquid collected therein into manifolds or other collection ducts.

7. A liquid collection trough assembly as claimed in claim 1 in which the collection trough assembly is installed beneath a fill or tube bundle of a cooling tower, condenser or dephlegmator.

8. A liquid collection trough assembly comprising a plurality of elongate troughs and associated inclined capture plates wherein each capture plate is arranged to receive liquid contacting same on a front face thereof and direct the liquid into an associated elongate trough, the liquid collection trough assembly wherein each capture plate has a generally upright deflection plate extending downwards from an upper region thereof on its rear face so as to be capable of receiving liquid droplets contacting it and directing such liquid into or onto an adjacent trough or capture plate, in use, wherein the deflection plate extends downwards to terminate in a bottom edge that is located downwards of said upper region of the capture plate and spaced rearwards of the rear face of an inclined portion of the capture plate, wherein the water collection troughs are arranged at regularly staggered vertical positions in a plurality of vertically spaced horizontal planes.

* * * * *